US006546367B2

(12) United States Patent
Otsuka

(10) Patent No.: US 6,546,367 B2
(45) Date of Patent: Apr. 8, 2003

(54) SYNTHESIZING PHONEME STRING OF PREDETERMINED DURATION BY ADJUSTING INITIAL PHONEME DURATION ON VALUES FROM MULTIPLE REGRESSION BY ADDING VALUES BASED ON THEIR STANDARD DEVIATIONS

(75) Inventor: Mitsuru Otsuka, Iwatsuki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/264,866

(22) Filed: Mar. 9, 1999

(65) Prior Publication Data

US 2002/0107688 A1 Aug. 8, 2002

(30) Foreign Application Priority Data

Mar. 10, 1998 (JP) ..... 10-057900

(51) Int. Cl.[7] ..... G10L 13/08; G10L 13/06
(52) U.S. Cl. ..... 704/260; 704/267; 704/278
(58) Field of Search ..... 704/260, 267, 704/278

(56) References Cited

U.S. PATENT DOCUMENTS

| | | | | | |
|---|---|---|---|---|---|
| 5,682,502 | A | | 10/1997 | Ohtsuka et al. | 704/267 |
| 6,038,533 | A | * | 3/2000 | Buchsbaum et al. | 704/260 |
| 6,064,960 | A | * | 5/2000 | Bellegarda et al. | 704/260 |
| 6,101,470 | A | * | 8/2000 | Eide et al. | 704/260 |

FOREIGN PATENT DOCUMENTS

| | | | |
|---|---|---|---|
| WO | WO 96/42079 | 12/1996 | G10L/5/04 |

OTHER PUBLICATIONS

Keikichi Hirose, Mayumi Sakata, and Hiromichi Kawanami "Synthesizing dialogue speech of Japanese based on the quantitative analysis of prosodic features," Proc. ICSLP 96, vol. 1, p. 378–381, Oct. 1996.*

Gerard Bailly "Integration of Rhythmic and Syntactic Constraints in a Model of Generation of French Prosody," Speech Communication, vol. 8, No. 2, p. 137–146, Jun. 1989.*

"Phoneme Control Using the Method of Categorial Multiple Regression for Synthesis by Rule," Sakayori, et al., Report of the 1986 Autumn Meeting of the Acoustic Society of Japan, 3–4–17, Oct. 1986.

Phoneme Duration Control for Speech Synthesis by Rule, Yoshinori Sagisaka, et al., The Journal of the Institute of Electronics and Communication Engineers of Japan, vol. J67–A, No. 7, 1984, pp. 629–636.

Mobius, et al. "Modeling Segmental Duration In German Text–to–Speech Synthesis", Proceedings ICSLP 96, 4$^{th}$ Internat'l Conf. pp. 2395–2398, vol. 4, Oct. 3–6, 1996.

Campbell, et al., "Duration Pitch And Diphones In the CSTR TTS System," Proceedings of Internat'l Conf. on Spoken Language Processing, Nov. 18, 1990, vol. 2, pp. 825–828.

The Transaction of the Institute of Electronics and Comm. Eng. Of Japan, vol. J67–A, No. 7, Jul. 1984, pp. 629–636, "Phoneme Duration Control for Speech Synthesis By Rule," Sagisaka, et al.

* cited by examiner

*Primary Examiner*—Tālivaldis Ivars Sm̄its
(74) *Attorney, Agent, or Firm*—Fitzpatrick, Cella, Harper & Scinto

(57) ABSTRACT

Statistical data including an average value, a standard deviation, and a minimum value of a phoneme duration of each phoneme is stored in a memory. When speech production time is determined for a phoneme string in a predetermined expiratory paragraph, the total phoneme duration of the phoneme string is set so as to become equal to the speech production time. Based on the set phoneme duration, phonemes are connected and a speech waveform is generated. To set a phoneme duration for each phoneme, a phoneme duration initial value is first set based on an average value, obtained by equally dividing the speech production time by phonemes of the phoneme string, and a phoneme duration range, phoneme. Then, set based on statistical data of each the phoneme duration initial value is adjusted based on the statistical data and the speech production time.

19 Claims, 10 Drawing Sheets

START
S1
CHARACTER STRING INPUT
S2
CONTROL DATA STORAGE
S3
PHONEME STRING GENERATION
S4
STORING PHONEME STRING OF NEXT PHONEME DURATION SETTING SECTION
S5
SETTING PHONEME TIME DURATION INITIAL VALUE
S6
SETTING PHONEME DURATION
S7
SPEECH SYNTHESIZING
S8
LAST PHONEME DURATION SETTING SECTION?
NO
YES
S10
CONTROL DATA STORAGE
S9
INPUT COMPLETED?
NO
YES
END

FIG.4

| PHONEME | $\mu$, $\sigma$, dmin | $\theta$ |
|---|---|---|
| a | $\mu_a$, $\sigma_a$, damin | $\theta_a$ |
| e | $\mu_e$, $\sigma_e$, demin | $\theta_e$ |
| i | $\mu_i$, $\sigma_i$, dimin | $\theta_i$ |
| ⋮ | ⋮ | ⋮ |

FIG.6

| $\alpha_1$ | $\alpha_2$ | $\alpha_3$ | $\alpha_4$ | $\alpha_5$ |
|---|---|---|---|---|
| o | X | s | e | i |

FIG.7

| FACTOR j | CATEGORY k | COEFFICIENT aj, k |
|---|---|---|
| 1 | 1 | $a_{1,1}$ |
| | 2 | $a_{1,2}$ |
| | ⋮ | ⋮ |
| | 27 | $a_{1,27}$ |
| 2 | ⋮ | ⋮ |
| ⋮ | | |

FIG.8

| PHONEME | $\Omega a$ OR $\Omega r$ | $\delta i(j,k)$ | $\mu$, $\sigma$, dmin OF CATEGORY 1 | --- | $\mu$, $\sigma$, dmin OF CATEGORY 5 | $\theta$ |
|---|---|---|---|---|---|---|
| a | $\Omega a$ | | $\mu a(1)$, $\sigma a(1)$ damin(1) | --- | $\mu a(5)$, $\sigma a(5)$ damin(5) | $\theta a$ |
| e | $\Omega r$ | $\delta e(1,1)$ $\sim \delta e(8,26)$ | $\mu e(1)$, $\sigma e(1)$ demin(1) | --- | $\mu e(5)$, $\sigma e(5)$ demin(5) | $\theta e$ |
| i | $\Omega r$ | $\delta i(1,1)$ $\sim \delta i(8,26)$ | $\mu i(1)$, $\sigma i(1)$ dimin(1) | --- | $\mu i(5)$, $\sigma i(5)$ dimin(5) | $\theta i$ |
| ⋮ | ⋮ | ⋮ | ⋮ | --- | ⋮ | ⋮ |

NUMBER OF COMPONENTS IN PHONEME STRING: I
(α1, α2, α3. . . . αI)
S201
DETERMINE CATEGORY n
S202
i←1
S203
S204
αi∈Ωr?
NO
YES
S205
S206
SET dαio BASED ON αj,k AND δi(j,k) OF PHONEME αi
DETERMINE dαio BASED ON μ OF PHONEME αi IN CATEGORY n
SET PHONEME DURATION INITIAL VALUE dαi BASED ON μ, σ AND dmin OF PHONEME αi IN CATEGORY n, AND dαio
S207
i←i+1
S208
S209
NO
i>I?
YES

SYNTHESIZING PHONEME STRING OF PREDETERMINED DURATION BY ADJUSTING INITIAL PHONEME DURATION ON VALUES FROM MULTIPLE REGRESSION BY ADDING VALUES BASED ON THEIR STANDARD DEVIATIONS

BACKGROUND OF THE INVENTION

The present invention relates to a method and an apparatus for speech synthesis utilizing a rule-based synthesis method, and a storage medium storing computer-readable programs for realizing the speech synthesizing method.

As a method of controlling a phoneme duration, a conventional rule-based speech synthesizing apparatus employs a control-rule method determined based on statistics related to a phoneme duration (Yoshinori SAGISAKA, Youichi TOUKURA, "Phoneme Duration Control for Rule-Based Speech Synthesis," The Journal of the Institute of Electronics and Communication Engineers of Japan, vol. J67-A, No. 7 (1984) pp 629–636), or a method of employing Categorical Multiple Regression as a technique of multiple regression analysis (Tetsuya SAKAYORI, Shoichi SASAKI, Hiroo KITAGAWA, "Prosodies Control Using Categorical Multiple Regression for Rule-Based Synthesis," "Report of the 1986 Autumn Meeting of the Acoustic Society of Japan," 3-4-17 (1986-10)).

However, according to the above conventional technique, it is difficult to specify the speech production time of a phoneme string. For instance, in the control-rule method, it is difficult to determine a control rule that corresponds to a specified speech-production time. Moreover, if input data includes an exception in the control rule method, or if a satisfactory estimation value is not obtained in the method of Categorical Multiple Regression, it becomes difficult to obtain a phoneme duration that sounds natural.

In a case of controlling a phoneme duration by using control rules, it is necessary to weigh the statistics (average value, standard deviation and so on) while taking into consideration of the combination of preceding and succeeding phonemes, or it is necessary to set an expansion coefficient. There are various factors to be manipulated, e.g., a combination of phonemes depending on each case, parameters such as weighting and expansion coefficients and the like. Moreover, the operation method (control rules) must be determined by rule of thumb. Therefore, in a case where a speech-production time of a phoneme string is specified, the number of combinations of phonemes become extremely large. Furthermore, it is difficult to determine control rules applicable to any combination of phonemes in which a total phoneme duration is close to the specified speech-production time.

SUMMARY OF THE INVENTION

The present invention is made in consideration of the above situation, and has as its object to provide a speech synthesizing method and apparatus as well as a storage medium, which enables setting the phoneme duration for a phoneme string so as to achieve a specified speech-production time, and which can provide a natural phoneme duration regardless of the length of speech production time.

In order to attain the above object, the speech synthesizing apparatus according to an embodiment of the present invention has the following configuration. More specifically, the speech synthesizing apparatus for performing speech synthesis according to an inputted phoneme string comprises:

storage means for storing statistical data related to a phoneme duration of each phoneme; determining means for determining speech production time of a phoneme string in a predetermined section; setting means for setting the phoneme duration corresponding to the speech-production time of each phoneme constructing the phoneme string, based on the statistical data of each phoneme obtained from the storage means; and generating means for generating a speech waveform by connecting phonemes using the phoneme duration.

Furthermore, the present invention provides a speech synthesizing method executed by the above speech synthesizing apparatus. Moreover, the present invention provides a storage medium storing control programs for having a computer realize the above speech synthesizing method.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

FIG. 4 is a table showing a configuration of phoneme data according to a first embodiment of the present invention;

FIG. 6 is a view showing an example of an inputted phoneme string;

FIG. 7 is a table showing a data configuration of a coefficient table storing coefficients $a_{j,k}$ for Categorical Multiple Regression according to a second embodiment of the present invention;

FIG. 8 is a table showing a data configuration of phoneme data according to the second embodiment of the present invention.

DETAILED DESCRIPTION OF THE PREFERRED EMBODIMENTS

Preferred embodiments of the present invention will be described in detail in accordance with the accompanying drawings.

First Embodiment

Figure 1:
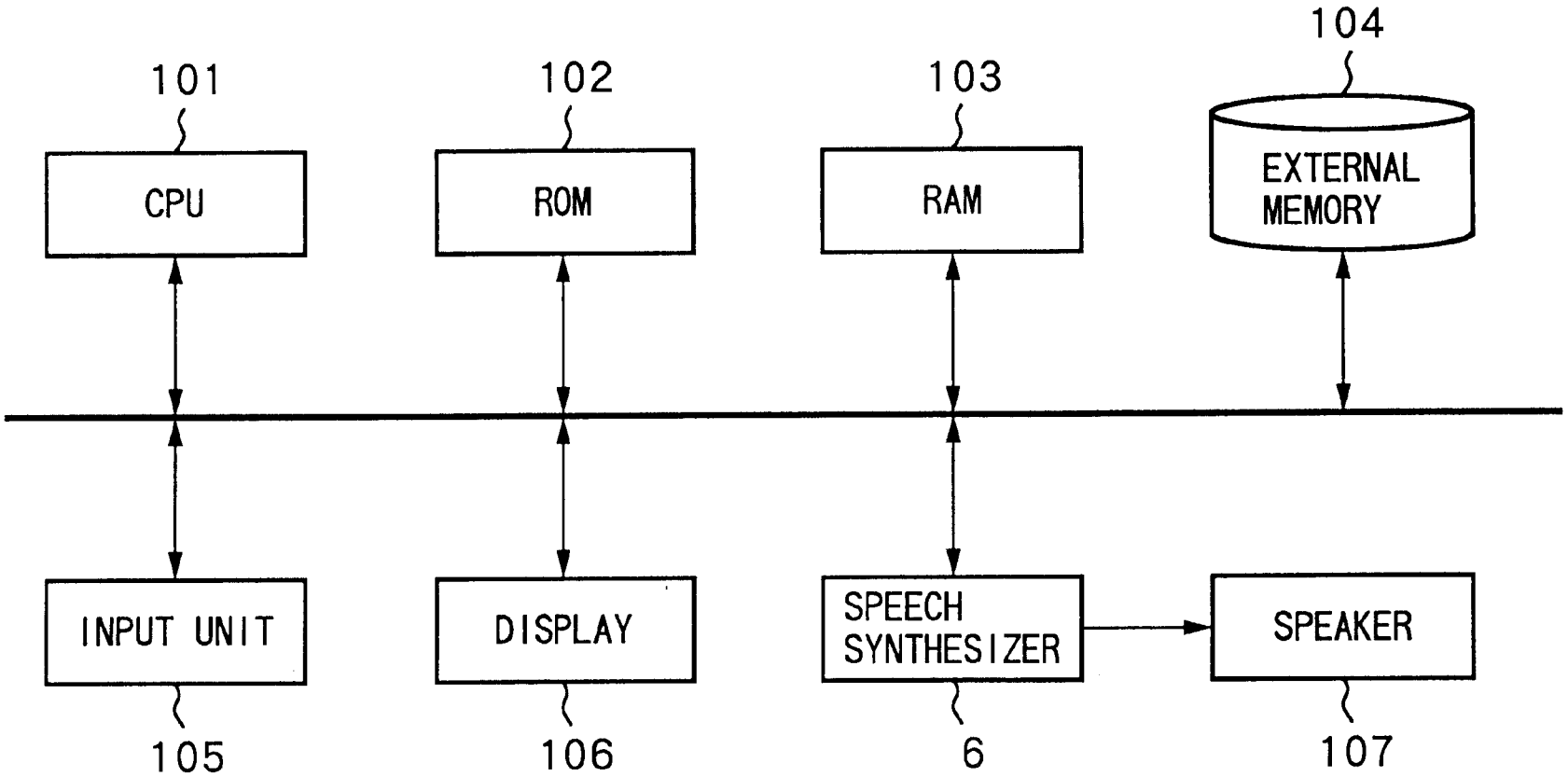
FIG. 1 is a block diagram showing a construction of a speech synthesizing apparatus according to an embodiment of the present invention.

FIG. 1 is a block diagram showing the construction of a speech synthesizing apparatus according to a first embodiment of the present invention. Reference numeral 101 denotes a CPU which performs various controls in the rule-based speech synthesizing apparatus of the present embodiment. Reference numeral 102 denotes a ROM where various parameters and control programs executed by the CPU 101 are stored. Reference numeral 103 denotes a RAM which stores control programs executed by the CPU 101 and serves as a work area of the CPU 101. Reference numeral 104 denotes an external memory such as hard disk, floppy disk, CD-ROM and the like. Reference numeral 105 denotes an input unit comprising a keyboard, a mouse and so forth. Reference numeral 106 denotes a display for performing various display according to the control of the CPU 101. Reference numeral 6 denotes a speech synthesizer for generating synthesized speech. Reference numeral 107 denotes a speaker where speech signals (electric signals) outputted by the speech synthesizer 6 are converted to sound and outputted.

Figure 2:
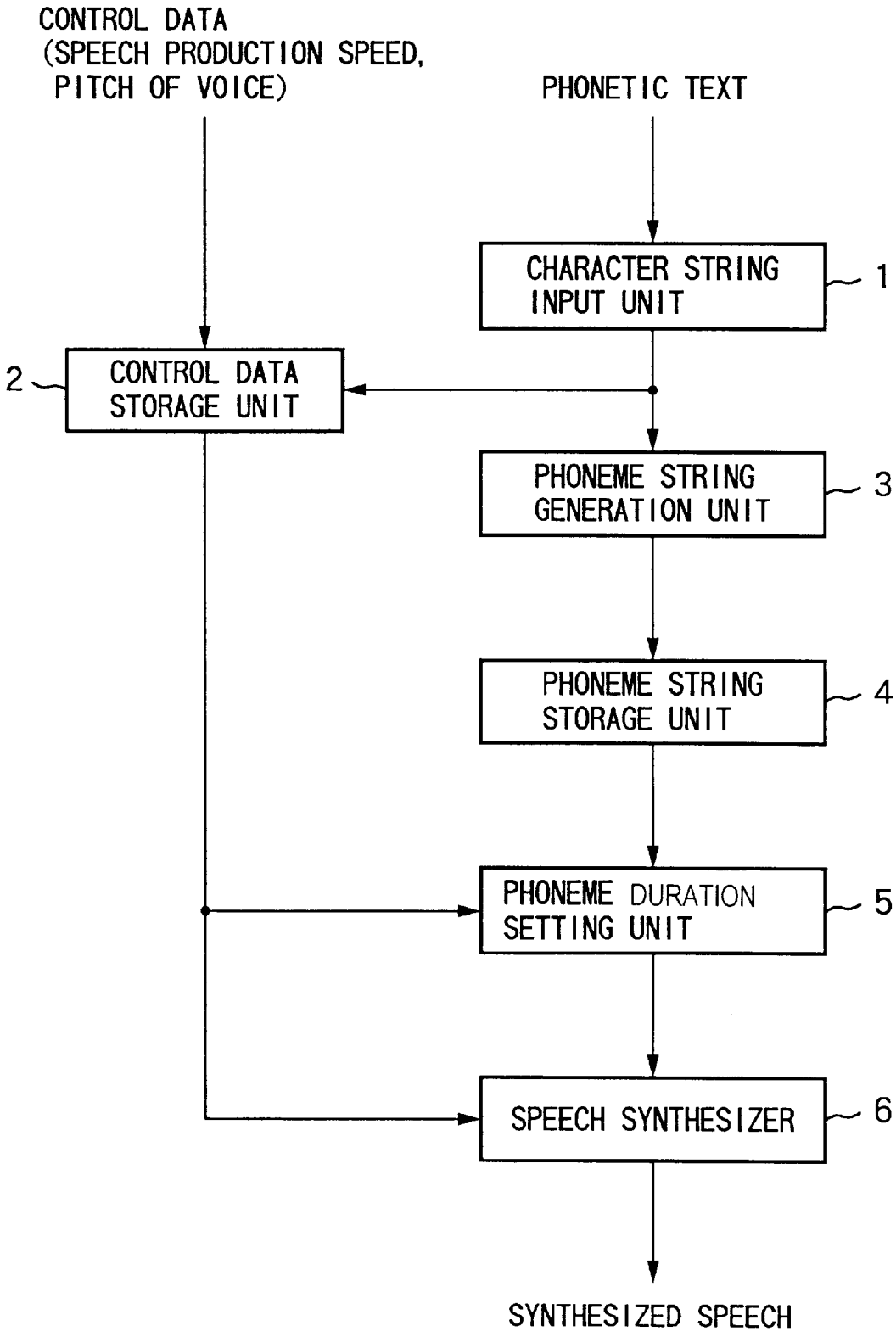
FIG. 2 is a block diagram showing a flow structure of the speech synthesizing apparatus according to the embodiment of the present invention.

FIG. 2 is a block diagram showing a flow structure of the speech synthesizing apparatus according to the first embodiment. Functions to be described below are realized by the CPU 101 executing control programs stored in the ROM 102 or executing control programs loaded from the external memory 104 to the RAM 103.

Reference numeral 1 denotes a character string input unit for inputting a character string of speech to be synthesized, i.e., phonetic text, which is inputted by the input unit 105. For instance, if the speech to be synthesized is "O•N•S•E•I", the character string input unit 1 inputs a character string "o, n, s, e, i". This character string sometimes contains a control sequence for setting the speech production speed or the pitch of voice. Reference numeral 2 denotes a control data storage unit for storing, in internal registers, information which is found to be a control sequence by the character string input unit 1, and control data such as the speech production speed and pitch of voice or the like inputted from a user interface. Reference numeral 3 denotes a phoneme string generation unit which converts a character string inputted by the character string input unit 1 into a phoneme string. For instance, the character string "o, n, s, e, i" is converted to a phoneme string "o, X, s, e, i". Reference numeral 4 denotes a phoneme string storage unit for storing the phoneme string generated by the phoneme string generation unit 3 in the internal registers. Note that the RAM 103 may serve as the aforementioned internal registers.

Reference numeral 5 denotes a phoneme duration setting unit which sets a phoneme duration in accordance with the control data, representing speech production speed stored in the control data storage unit 2, and the type of phoneme stored in the phoneme string storage unit 4. Reference numeral 6 denotes a speech synthesizer which generates synthesized speech from the phoneme string in which phoneme duration is set by the phoneme duration setting unit 5 and the control data, representing pitch of voice, stored in the control data storage unit 2.

Next, a description will be provided on setting a phoneme duration, which is executed by the phoneme duration setting unit 5. In the following description, Ω indicates a set of phonemes. As an example of Ω, the following may be used:

Ω={a, e, i, o, u, X (syllabic nasal), b, d, g, m, n, r, w, y, z, ch, f, h, k, p, s, sh, t, ts, Q (double consonant)}

Herein, it is assumed that a phoneme duration setting section is an expiratory paragraph (section between pauses). The phoneme duration di for each phoneme αi of the phoneme string is determined such that the phoneme string constructed by phonemes αi (1≦i≦N) in the phoneme duration setting section is phonated within the speech production time T, determined based on the control data representing speech production speed stored in the control data storage unit 2. In other words, the phoneme duration di (equation (1b)) for each αi (equation (1a)) of the phoneme string is determined so as to satisfy the equation (1c).

$$\alpha i \in \Omega (1 \le i \le N) \tag{1a}$$

$$di (1 \le i \le N) \tag{1b}$$

$$T = \sum_{i=1}^{N} di \tag{1c}$$

Herein, the phoneme duration initial value of the phoneme αi is defined as dαi0. The phoneme duration initial value dαi0 is obtained by, for instance, dividing the speech production time T by the number N of the phoneme string. With respect to the phoneme αi, an average value, standard deviation, and the minimum value of the phoneme duration are respectively defined as μαi, σαi, dαimin. Using these values, the initial value dαi is determined by the equation (2), and the obtained value is set as a new phoneme duration initial value. More specifically, the average value, standard deviation value, and minimum value of the phoneme duration are obtained for each type of the phoneme (for each αi), stored in a memory, and the initial value of the phoneme duration is determined again using these values.

$$d_{\alpha i} = \begin{cases} \max(\mu_{\alpha i} - 3\sigma_{\alpha i}, d_{\alpha i\min}) & \text{where } (d_{\alpha i0} < \max(\mu_{\alpha i} - 3\sigma_{\alpha i}, d_{\alpha i\min})) \\ d_{\alpha i0} & \text{where } (\max(\mu_{\alpha i} - 3\sigma_{\alpha i}, d_{\alpha i\min}) \le d_{\alpha i0} \le \mu_{\alpha i} + 3\sigma_{\alpha i}) \\ \mu_{\alpha i} + 3\sigma_{\alpha i} & \text{where } (\mu_{\alpha i} + 3\sigma_{\alpha i} < d_{\alpha i0}) \end{cases} \tag{2}$$

Using the phoneme duration initial value dαi obtained in this manner, the phoneme duration di is determined according to the following equation (3a). Note that if the obtained phoneme duration di satisfies di<θμi where θαi (>0) is a threshold value, di is set according to equation (3b). The reason that di is set to θαi is that reproduced speech becomes unnatural if di is too short.

$$d_i = d_{\alpha i} + \rho(\sigma_{\alpha i})^2 \tag{3a}$$

$$\text{where } \rho = \frac{\left(T - \sum_{i=1}^{N} d_{\alpha i}\right)}{\sum_{i=1}^{N} (\sigma_{\alpha i})^2}$$

$$di = \theta i \tag{3b}$$

More specifically, the sum of the updated initial values of the phoneme duration is subtracted from the speech production time T, and the resultant value is divided by a sum of square of the standard deviation σαi of the phoneme duration. The resultant value is set as a coefficient ρ. The product of the coefficient ρ and a square of the standard deviation σαi, is added to the initial value dαi of the phoneme duration, and as a result, the phoneme duration di is obtained.

The foregoing operation is described with reference to the flowchart in FIG. 3.

First in step S1, a phonetic text is inputted by the character string input unit 1. In step S2, control data (speech production speed, pitch of voice) inputted externally and the control data in the phonetic text inputted in step S1 are stored in the control data storage unit 2. In step S3, a phoneme string is generated by the phoneme string generation unit 3 based on the phonetic text inputted by the character string input unit 1.

Next in step S4, a phoneme string of the next phoneme duration setting section is stored in the phoneme string storage unit 4. In step S5, the phoneme duration setting unit 5 sets the phoneme duration initial value dαi in accordance with the type of phoneme αi (equation (2)). In step S6, speech production time T of the phoneme duration setting section is set based on the control data representing speech production speed, stored in the control data storage unit 2. Then, a phoneme duration is set for each phoneme string of the phoneme duration setting section using the above described equations (3a) and (3b) such that the total phoneme duration of the phoneme string in the phoneme duration setting section equals to the speech production time T of the phoneme duration setting section.

In step S7, a synthesized speech is generated based on the phoneme string where the phoneme duration is set by the phoneme duration setting unit 5 and the control data represents the pitch of voice stored in the control data storage unit 2. In step S8, it is determined whether or not the inputted character string is the last phoneme duration setting section, and if it is not the last phoneme duration setting section, the externally inputted control data is stored in the control data storage unit 2 in step S10, then the process returns to step S4 to continue processing.

Meanwhile, if it is determined in step S8 that the inputted character string is the last phoneme duration setting section, the process proceeds to step S9 for determining whether or not all input has been completed. If input is not completed, the process returns to step S1 to repeat the above processing.

The process of determining the duration for each phoneme, performed in steps S5 and S6, is described further in detail.

FIG. 4 is a table showing a configuration of phoneme data according to the first embodiment. As shown in FIG. 4, phoneme data includes the average value $\mu$ of the phoneme duration, the standard deviation σ, the minimum value dmin, and a threshold value θ with respect to each phoneme (a, e, i, o, u . . . ) of the set of phonemes Ω.

Figure 3:
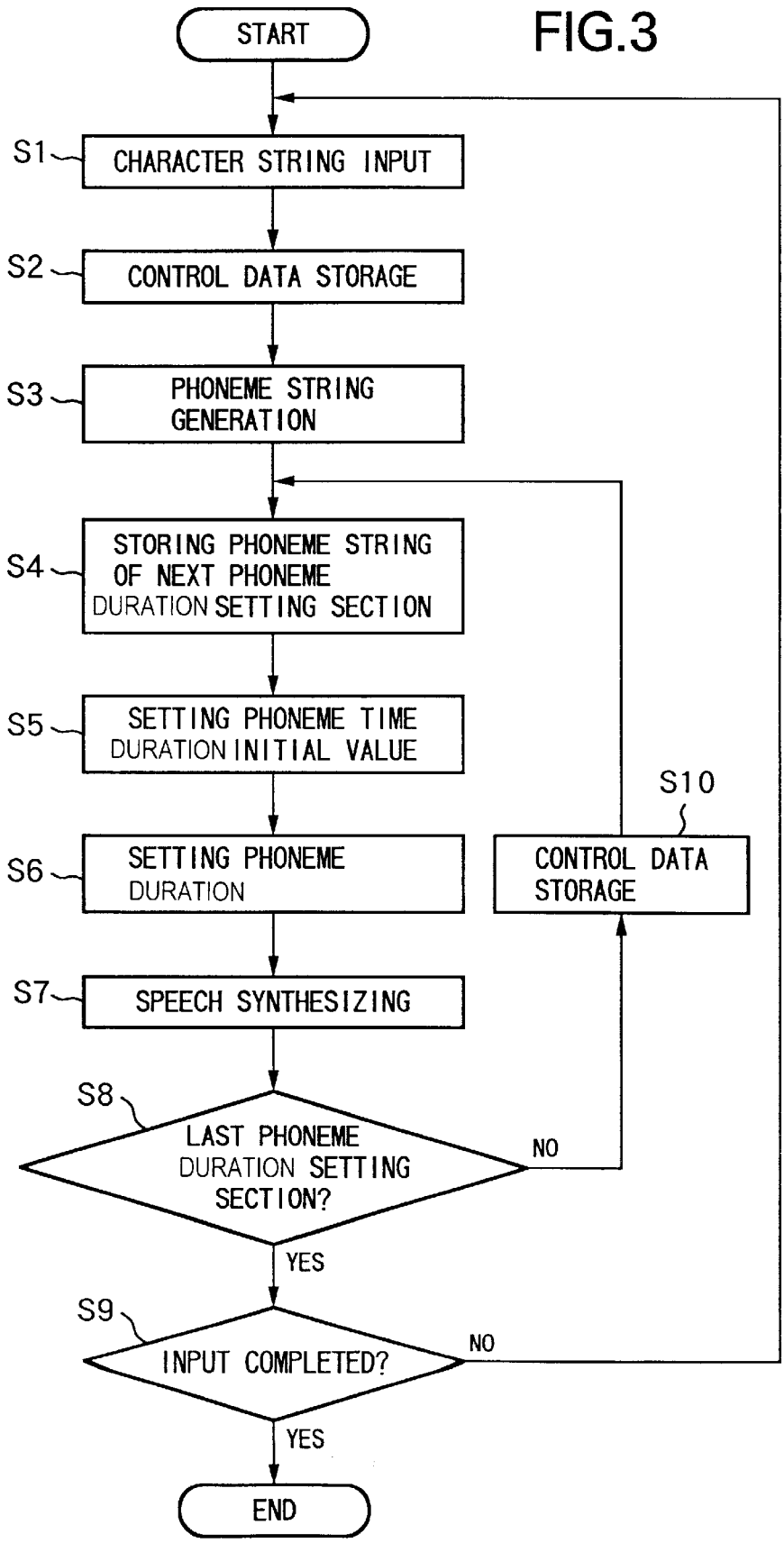
FIG. 3 is a flowchart showing speech synthesis steps according to the embodiment of the present invention.
Figure 5:
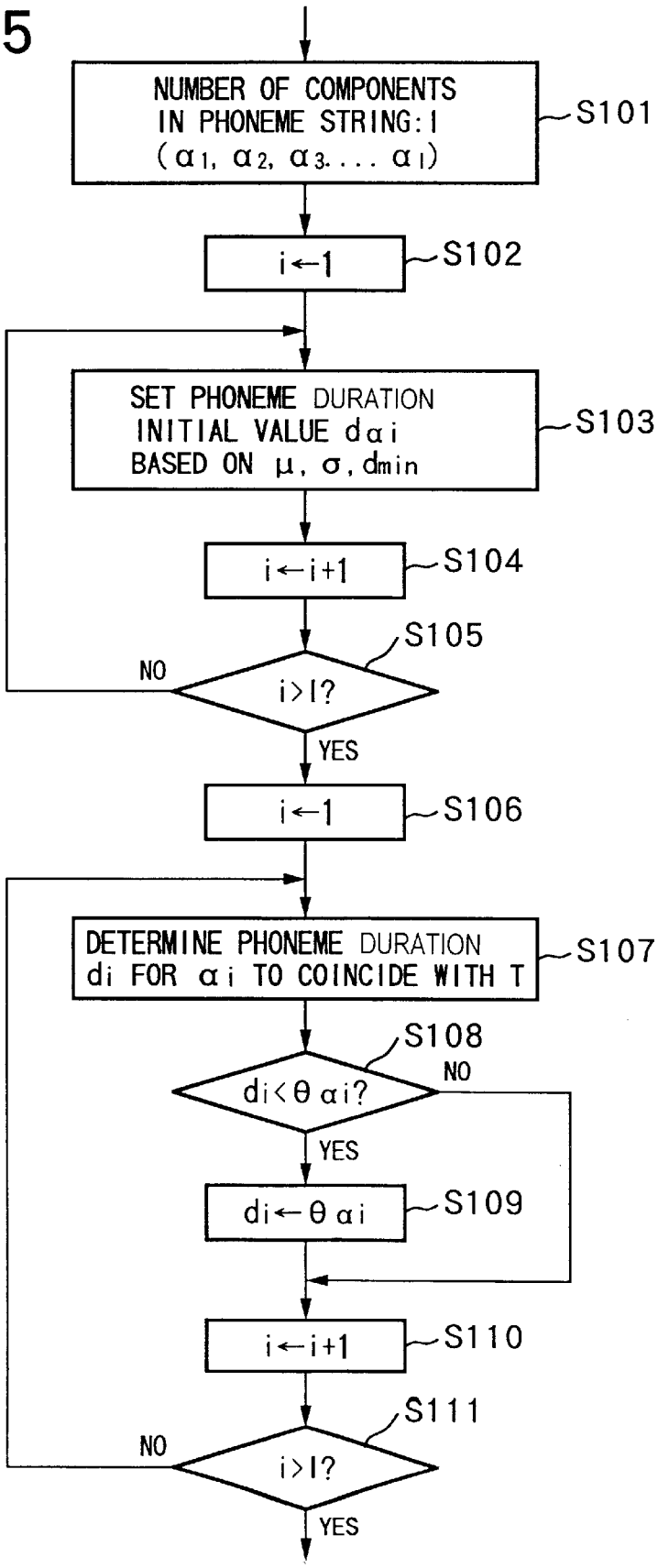
FIG. 5 is a flowchart showing a determining process of a phoneme duration according to the first embodiment of the present invention.

FIG. 5 is a flowchart showing the process of determining a phoneme duration according to the first embodiment, which shows the detailed process of steps S5 and S6 in FIG. 3.

First in step S101, the number of components I in the phoneme string (obtained in step S4 in FIG. 3) and each of the components α1 to αI, obtained with respect to the expiratory paragraph subject to processing, are determined. For instance, if the phoneme string comprises "o, X, s, e, i", α1 to α5 are determined as shown in FIG. 6, and the number of components I is 5. In step S102, the variable i is initialized to 1, and the process proceeds to step S103.

In step S103, the average value $\mu$, the standard deviation σ, and the minimum value dmin for the phoneme αi are obtained based on the phoneme data shown in FIG. 4. By using the obtained data, the phoneme duration initial value dαi is determined from the above equation (2). The calculation of the phoneme duration initial value dαi in step S103 is performed for all the phoneme strings subject to processing. More specifically, the variable i is incremented in step S104, and step S103 is repeated as long as the variable i is smaller than I in step S105.

The foregoing steps S101 to S105 correspond to step S5 in FIG. 3. In the above-described manner, the phoneme duration initial value is obtained for all the phoneme strings with respect to the expiratory paragraph subject to processing, and the process proceeds to step S106.

In step S106, the variable i is initialized to 1. In step S107, the phoneme duration di for the phoneme αi is determined so as to coincide with the speech production time T of the expiratory paragraph, based on the phoneme duration initial value for all the phonemes in the expiratory paragraph obtained in the previous process and the standard deviation of the phoneme αi (i.e., determined according to the equation (3a)). If the phoneme duration di obtained in step S107 is smaller than a threshold value θαi set for the phoneme αi, the threshold value θαi is set to di (steps S108 and S109)

The calculation of the phoneme duration di in steps S107 to S109 is performed for all the phoneme strings subject to processing. More specifically, the variable i is incremented in step S110, and steps S107 to S109 are repeated as long as the variable i is smaller than I in step S111.

The foregoing steps S106 to S111 correspond to step S6 in FIG. 3. In the above-described manner, the phoneme duration of all the phoneme strings for attaining the production time T is obtained with respect to the expiratory paragraph subject to processing.

Equation (2) serves to prevent the phoneme duration initial value from being set to an unrealistic value or a low occurrence probability value. Assuming that a probability density of the phoneme duration has a normal distribution, the probability of the initial value falling within the range from the average value to a value±three times of the standard deviation is 0.996. Furthermore, in order not to set the phoneme duration to a too small a value, the value is set no less than the minimum value of a sample group of natural speech production.

Equation (3a) is obtained as a result of executing maximum likelihood estimation under the condition of equation (1c), assuming that the normal distribution having the phoneme duration initial value set in equation (2) as an average value is the probability density function for each phoneme duration. The maximum likelihood estimation is described hereinafter.

Assume that the standard deviation of a phoneme duration of the phoneme αi is σαi. Also assume that the probability density distribution of the phoneme duration has a normal distribution (equation (4a)). In this condition, the logarithmic likelihood of the phoneme duration is expressed as equation (4b). Herein, achieving the largest logarithmic likelihood is equivalent to obtaining the smallest value K in equation (4c). The phoneme duration di satisfying the above equation (1c) is determined so that the logarithmic likelihood of the phoneme duration is the largest.

$$P_{\alpha i}(d_i) = \left(\sqrt{2\pi}\,\sigma_{\alpha i}\right)^{-1} \exp\left(-\frac{(d_i - d_{\alpha i})^2}{2(\sigma_{\alpha i})^2}\right) \tag{4a}$$

$$\begin{aligned}\log(L(d_i)) &= \log\left(\prod_{i=1}^{N} P_{\alpha i}(d_i)\right) \\ &= -\sum_{i=1}^{N} \log\left(\sqrt{2\pi}\,\sigma_{\alpha i}\right) - \frac{1}{2}\sum_{i=1}^{N} \frac{(d_i - d_{\alpha i})^2}{(\sigma_{\alpha i})^2}\end{aligned} \tag{4b}$$

$$K = \sum_{i=1}^{N} \frac{(d_i - d_{\alpha i})^2}{(\sigma_{\alpha i})^2} \tag{4c}$$

where $P_{\alpha i}(d_i)$: probability density function of the duration of the phoneme αi $L(d_i)$: likelihood of the phoneme duration Herein, if variable conversion is performed as shown in equation (5a), equations (4c) and (1c) are expressed by equations (5b) and (5c) respectively. When a sphere (equation (5b)) comes in contact with a plane (equation (5c)), i.e., the case of equation (5d), the value K has the smallest value. As a result, equation (3a) is obtained.

$$\rho_i = \frac{d_i - d_{\alpha i}}{\sigma_{\alpha i}} \tag{5a}$$

$$K = \sum_{i=1}^{N} \rho_i^2 \tag{5b}$$

$$\sum_{i=1}^{N} \rho_i \sigma_{\alpha i} = T - \sum_{i=1}^{N} d_{\alpha i} \tag{5c}$$

$$\rho_i = \rho \sigma_{\alpha i} \tag{5d}$$

$$\text{where } \rho = \frac{\left(T - \sum_{i=1}^{N} d_{\alpha i}\right)}{\sum_{i=1}^{N} (\sigma_{\alpha i})^2}$$

Taking equations (2), (3a) and (3b) into consideration, with the use of the statistics (average value, standard deviation, minimum value) obtained from a sample group of natural speech production, the phoneme duration is set to the most probable value (highest maximum likelihood) which satisfies a desired speech production time (equation (1c)). Accordingly, it is possible to obtain a natural phoneme duration, i.e., an error occurring in the phoneme duration is small when speech is produced to satisfy desired speech production time (equation (1c)).

Second Embodiment

In the first embodiment, the phoneme duration di of each phoneme αi is determined according to a rule without considering the speech production speed or the category of the phoneme. In the second embodiment, the rule for determining a phoneme duration di is varied in accordance with the speech production speed or the category of the phoneme to realize more natural speech synthesis. Note that the hardware construction and the functional configuration of the second embodiment are the same as that of the first embodiment (FIGS. 1 and 2).

A phoneme αi is categorized according to the speech production speed, and the average value, standard deviation, and minimum value are obtained. For instance, categories of speech production speed are expressed as follows using an average mora duration in an expiratory paragraph:

1: less than 120 milliseconds

2: equal to or greater than 120 milliseconds and less than 140 milliseconds

3: equal to or greater than 140 milliseconds and less than 160 milliseconds

4: equal to or greater than 160 milliseconds and less than 180 milliseconds

5: equal to or greater than 180 milliseconds

Note that the numeral value assigned to each category is a category index corresponding to each speech production speed. Herein, if the category index corresponding to a speech production speed is defined as n, the average value, standard deviation, and the minimum value of the phoneme duration are respectively expressed as $\mu\alpha i(n)$, $\sigma\alpha i(n)$, $d\alpha imin(n)$.

The phoneme duration initial value of the phoneme αi is defined as dαi0. In a set of phonemes Ωa, the phoneme duration initial value dαi0 is determined by an average value. In a set of phonemes Ωr, the phoneme duration initial value dαi0 is determined by one of a multiple regression analysis, and a Categorical Multiple Regression (a technique for explaining or predicting a quantitative external reference based on qualitative data). Phonemes Ω do not contain elements not included in either one of Ωa or Ωr, or elements included in both Ωa and Ωr. In other words, the set of phonemes satisfies the following equations (6a) and (6b).

$$\Omega_\alpha \cup \Omega_r = \Omega \tag{6a}$$

$$\Omega_\alpha \cap \Omega_r = \phi \tag{6b}$$

When αi ∈Ωa, i.e., αi belongs to Ωa, the phoneme duration initial value is determined by an average value. More specifically, the category index n corresponding to speech production speed is obtained and the phoneme duration initial value is determined by the following equation (7):

$$d_{\alpha o0} = \mu_{\alpha i}(n) \tag{7}$$

Meanwhile, when αi ∈Ωr, i.e., αi belongs to Ωr, the phoneme duration initial value is determined by Categorical Multiple Regression. Herein, assuming that index of factors is j ($1 \leqq j \leqq J$) and the category index corresponding to each factor is k ($1 \leqq k \leqq K(j)$), the coefficient for Categorical Multiple Regression corresponding to (j, k) is $a_{j,k}$.

For instance, the following factors may be used.

1: the phoneme, two phonemes preceding the subject phoneme

2: the phoneme, one phoneme preceding the subject phoneme

3: subject phoneme

4: the phoneme, one phoneme succeeding the subject phoneme

5: the phoneme, two phonemes succeeding the subject phoneme

6: an average mora duration in an expiratory paragraph

7: mora position in an expiratory paragraph

8: part of speech of the word including a subject phoneme

The numeral assigned to each of the above factors indicates an index of a factor j.

Examples of categories corresponding to each factor are provided hereinafter. Categories of phonemes are:

1: a, 2: e, 3: i, 4: o, 5: u, 6: X, 7: b, 8: d, 9: g, 10: m, 11: n, 12: r, 13: w, 14: y, 15: z, 16: +, 17: c, 18: f, 19: h, 20: k, 21: p, 22: s, 23: sh, 24: t, 25: ts, 26: Q, 27: pause. When the factor is "subject phoneme", "pause" is removed. Although the expiratory paragraph is defined as a phoneme duration setting section in the present embodiment, since the expiratory paragraph does not include a pause, "pause" is removed from the subject phoneme. Note that the term "expiratory paragraph" defines a section between pauses (the start and end of the sentence), which does not include a pause in the middle.

Categories of an average mora duration in an expiratory paragraph include the followings:

1: less than 120 milliseconds

2: equal to or greater than 120 milliseconds and less than 140 milliseconds

3: equal to or greater than 140 milliseconds and less than 160 milliseconds

4: equal to or greater than 160 milliseconds and less than 180 milliseconds

5: equal to or greater than 180 milliseconds

Categories of a mora position include the followings:

1: first mora

2: second mora

3: third mora from the beginning and the third mora from the end

4: the second mora from the end

5: end mora

Categories of a part of speech (according to Japanese grammar) include the followings:

1: noun, 2: adverbial noun, 3: pronoun, 4: proper noun, 5: number, 6: verb, 7: adjective, 8: adjectival verb, 9: adverb, 10: attributive, 11: conjunction, 12: interjection, 13: auxiliary verb, 14: case particle, 15: subordinate particle, 16: collateral particle, 17: auxiliary particle, 18: conjunctive particle, 19: closing particle, 20: prefix, 21: suffix, 22: adjectival verbal suffix, 23: sa-irregular conjugation suffix, 24: adjectival suffix, 25: verbal suffix, 26: counter Note that factors (also called items) indicate the type of qualitative data used in the prediction of Categorical Multiple Regression. The categories indicate possible selections for each factor. The followings are provided based on the above examples.

index of factor j=1: the phoneme, two phonemes preceding the subject phoneme category corresponding to index k=1: a category corresponding to index k=2: e category corresponding to index k=3: i category corresponding to index k=4: o

. . .

category corresponding to index k=26: Q category corresponding to index k=27: pause index of factor j=2: the phoneme, one phoneme preceding the subject phoneme category corresponding to index k=1: a category corresponding to index k=2: e category corresponding to index k=3: i category corresponding to index k=4: o

. . .

category corresponding to index k=26: Q category corresponding to index k=27: pause index of factor j=3: the subject phoneme category corresponding to index k=1: a category corresponding to index k=2: e category corresponding to index k=3: i category corresponding to index k=4: o

. . .

category corresponding to index k=26: Q index of factor j=4: the phoneme, one phoneme succeeding the subject phoneme category corresponding to index k=1: a category corresponding to index k=2: e category corresponding to index k=3: i category corresponding to index k=4: o

. . .

category corresponding to index k=26: Q category corresponding to index k=27: pause index of factor j=5: the phoneme, two phonemes succeeding the subject phoneme category corresponding to index k=1: a category corresponding to index k=2: e category corresponding to index k=3: i category corresponding to index k=4: o

. . .

category corresponding to index k=26: Q category corresponding to index k=27: pause index of factor j=6: an average mora duration in an expiratory paragraph category corresponding to index k=1: less than 120 milliseconds category corresponding to index k=2: equal to or greater than 120 milliseconds and less than 140 milliseconds category corresponding to index k=3: equal to or greater than 140 milliseconds and less than 160 milliseconds category corresponding to index k=4: equal to or greater than 160 milliseconds and less than 180 milliseconds category corresponding to index k=5: equal to or greater than 180 milliseconds index of factor j=7: mora position in an expiratory paragraph category corresponding to index k=1: first mora category corresponding to index k=2: second mora

. . .

category corresponding to index k=5: end mora index of factor j=8: part of speech of the word including a subject phoneme category corresponding to index k=1: noun category corresponding to index k=2: adverbial noun

. . .

category corresponding to index k=26: counter

It is so set that the average value of the coefficient $a_{j,k}$ for each factor is 0, i.e., equation (8) is satisfied. Note that the coefficient $a_{j,k}$ is stored in the external memory 104 as will be described later in FIG. 7.

$$\sum_{k=1}^{K(j)} a_{jk} = 0 (1 \le j \le J) \tag{8}$$

Furthermore, a dummy variable of the phoneme αi is set as follows.

$$\delta_1(j,k) = \begin{cases} 1\left(\begin{array}{c}\text{phoneme } \alpha_i \text{ has value for category} \\ k \text{ of factor } j\end{array}\right) \\ 0(\text{case other than above}) \end{cases} \tag{9}$$

A constant to be added to the sum of products of the coefficient and the dummy variable is c0. An estimated value of a phoneme duration of the phoneme αi according to Categorical Multiple Regression is expressed as equation (10).

$$\hat{d}_{\alpha i} = \sum_{j=1}^{J} \sum_{k=1}^{K(j)} a_{jk} \delta_i(j,k) + c0 \tag{10}$$

Using the estimated value, the phoneme duration initial value of the phoneme αi is determined by equation 11.

$$d_{\alpha i0} = \hat{d}_{\alpha i} \tag{11}$$

Furthermore, the category index n corresponding to speech production speed is obtained, then the average value, standard deviation, and minimum value of the phoneme duration in the category are obtained. With these values, the phoneme duration initial value dαi0 is updated by the following equation (12). The obtained initial value dαi0 is set as a new phoneme duration initial value.

$$d_{\alpha i} = \begin{cases} \max(\mu_{\alpha i}(n) - r_\sigma \sigma_{\alpha i}(n),\ d_{\alpha i\min}(n)) \\ \text{if } (d_{\alpha i0} < \max(\mu_{\alpha i}(n) - r_\sigma \sigma_{\alpha i}(n),\ d_{\alpha i\min}(n))) \\ d_{\alpha i0} \text{ if } \max(\mu_{\alpha i}(n) - r_\sigma \sigma_{\alpha i}(n), \\ d_{\alpha i\min}(n)) \le d_{\alpha i0} \le \mu_{\alpha i}(n) + r_\sigma \sigma_{\alpha i}(n)) \\ \mu_{\alpha i}(n) + r_\sigma \sigma_{\alpha i}(n) \\ \text{if } (\mu_{\alpha i}(n) + r_\sigma \sigma_{\alpha i}(n) < d_{\alpha i0}) \end{cases} \tag{12}$$

A coefficient $r_\sigma$ which is multiplied by the standard deviation in equation (12) is set as, e.g., $r_\sigma$=3. With the phoneme duration initial value obtained in the foregoing manner, the phoneme duration is determined by the method similar to that described in the first embodiment. More specifically, the phoneme duration di is determined using the following equation (13a). The phoneme duration di is determined by equation (13b) if a threshold value θαi (>0) satisfies di<θαi.

$$d_i = d_{\alpha i} + \rho(\sigma_{\alpha i}(n))^2 \tag{13a}$$

$$\text{where } \rho = \frac{\left(T - \sum_{i=1}^{N} d_{\alpha i}\right)}{\sum_{i=1}^{N} (\sigma_{\alpha i}(n))^2}$$

$$d_i = \theta_i \tag{13b}$$

The above-described operation will be described with reference to the flowchart in FIG. 3. In step S1, a phonetic text is inputted by the character string input unit 1. In step S2, control data (speech production speed, pitch of voice) inputted externally and the control data in the phonetic text inputted in step S1 are stored in the control data storage unit 2. In step S3, a phoneme string is generated by the phoneme string generation unit 3 based on the phonetic text inputted by the character string input unit 2. In step S4, a phoneme string of the next duration setting section is stored in the phoneme string storage unit 4.

In step S5, the phoneme duration setting unit 5 sets the phoneme duration initial value in accordance with the type of phoneme (category) by using the above-described method, based on the control data representing speech production speed stored in the control data storage unit 2, the average value, the standard deviation and minimum value of the phoneme duration, and the phoneme duration estimation value estimated by Categorical Multiple Regression.

In step S6, the phoneme duration setting unit 5 sets speech production time of the phoneme duration setting section based on the control data representing the speech production speed, stored in the control data storage unit 2. Then, the phoneme duration is set for each phoneme string of the phoneme duration setting section using the above-described method such that the total phoneme duration of the phoneme string in the phoneme duration setting section equals to the speech production time of the phoneme duration setting section.

In step S7, synthesized speech is generated based on the phoneme string where the phoneme duration is set by the phoneme duration setting unit 5 and the control data representing pitch of voice stored in the control data storage unit 2. In step S8, it is determined whether or not the inputted character string is the last phoneme duration setting section, and if it is not the last phoneme duration setting section, the process proceeds to step S10. In step S10, the control data externally inputted is stored in the control data storage unit 2, then the process returns to step S4 to continue processing. Meanwhile, if it is determined in step S8 that the inputted character string is the last phoneme duration setting section, the process proceeds to step S9 for determining whether or not all input has been completed. If input is not completed, the process returns to step S1 to repeat the above processing.

The process of determining the duration for each phoneme, performed in steps S5 and S6 according to the second embodiment, is described further in detail.

FIG. 7 is a table showing a data configuration of a coefficient table storing the coefficient $a_{j,k}$ for Categorical Multiple Regression according to a second embodiment. As described above, the factor j of the present embodiment includes factors 1 to 8. For each factor, a coefficient $a_{j,k}$ corresponding to the category is registered.

For instance, there are twenty-seven categories (phoneme categories) for the factor j=1, and twenty-seven coefficients $a_{1,1}$ to $a_{1,27}$ are stored.

FIG. 8 is a table showing a data configuration of phoneme data according to the second embodiment. As shown in FIG. 8, phoneme data includes a flag indicative of whether a phoneme belongs to Ωa or Ωr, a dummy variable δ(j,k) indicative of whether or not a phoneme has a value for category k of the factor j, an average value μ, a standard deviation σ, a minimum value dmin, and a threshold value θ of the phoneme duration for each category of speech production time with respect to each phoneme (a, e, i, o, u . . . ) of the set of phonemes Ω.

With the data shown in FIGS. 7 and 8, steps S5 and S6 in FIG. 3 are executed. Hereinafter, this process will be described in detail with reference to the flowchart in FIGS. 9A and 9B.

Figure 9A:
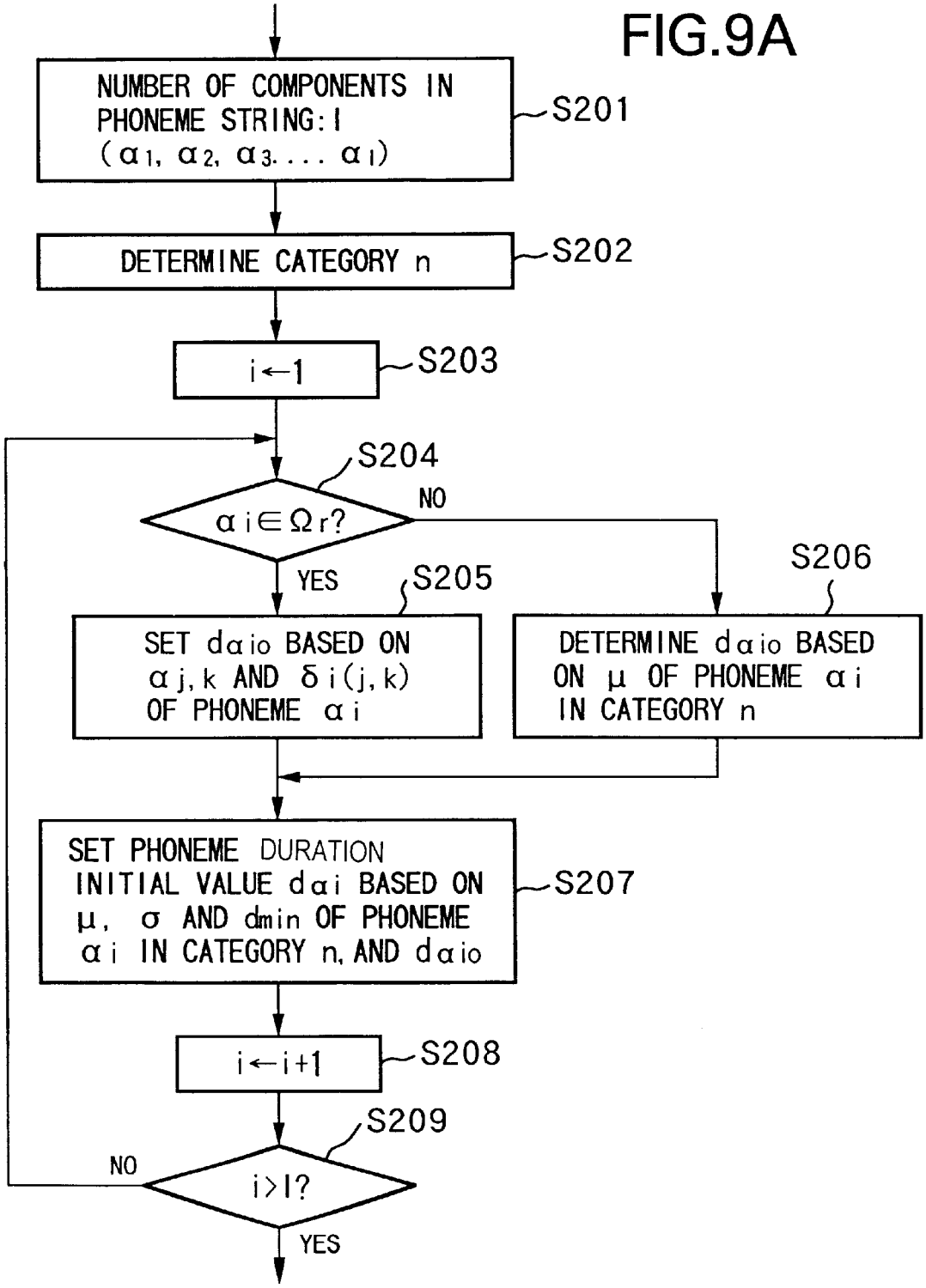
FIGS. 9A and 9B are flowcharts showing a determining process of a phoneme duration according to the second embodiment of the present invention.
Figure 9B:
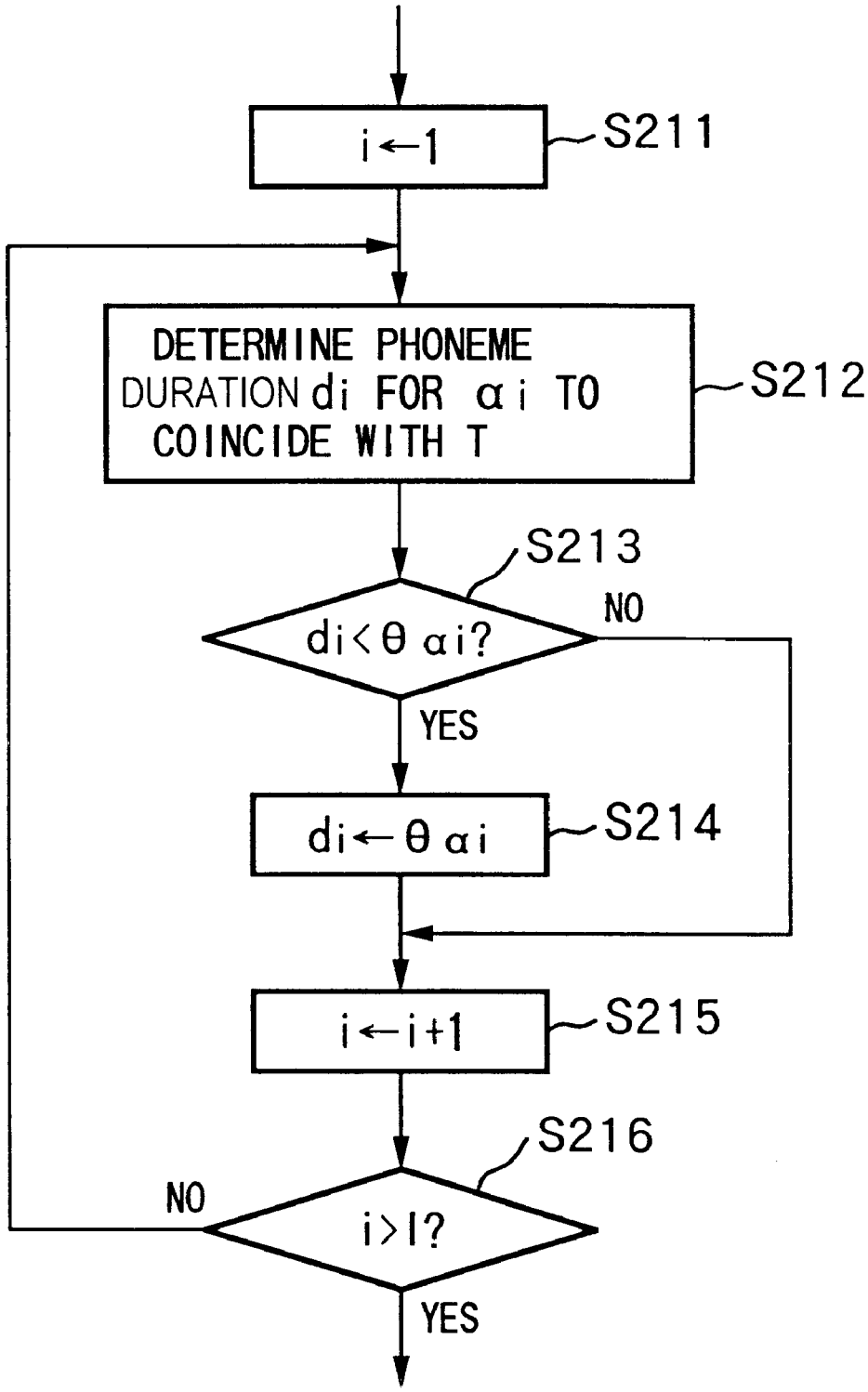

In step S201 in FIG. 9A, the number of components I in the phoneme string and each of the components αI, obtained with respect to the expiratory paragraph subject to processing (obtained in step S4 in FIG. 3), are determined. For instance, if the phoneme string comprises "o, X, s, E, i ", α1 to α5 are determined as shown in FIG. 6, and the number of components I is 5. In step S202, a category n corresponding to speech production speed is determined. In the present embodiment, the speech production time T of the expiratory paragraph is determined based on the speech production speed represented by control data. The time T is divided by the number of components I of the phoneme string in the expiratory paragraph to obtain an average mora duration, and the category n is determined. In step S203, the variable i is initialized to 1, and the phoneme duration initial value is obtained by the following steps S204 to S209.

In step S204, phoneme data shown in FIG. 8 is referred in order to determine whether or not the phoneme αi belongs to Ωr. If the phoneme αi belongs to Ωr, the process proceeds to step S205 where the coefficient $a_{j,k}$ is obtained from the coefficient table shown in FIG. 7 and the dummy variable (δi(j,k)) of the phoneme αi is obtained from the phoneme data shown in FIG. 8. Then dαi0 is calculated using the aforementioned equations (10) and (11). Meanwhile if the phoneme αi belongs to Ωa in step S204, the process proceeds to step S206 where an average value μ of the phoneme αi in the category n is obtained from the phoneme table, and dαi0 is obtained by equation (7).

Then, the process proceeds to step S207 where the phoneme duration initial value dαi of the phoneme αi is determined by equation (12), utilizing μ, σ, dmin of the phoneme $\alpha i$ in the category n which are obtained from the phoneme table, and $d\alpha i0$ obtained in step S205 or S206.

The calculation of the phoneme duration initial value $d\alpha i0$ in steps S204 to S207 is performed for all the phoneme strings subject to processing. More specifically, the variable i is incremented in step S208, and steps S204 to S207 are repeated as long as the variable i is smaller than I in step S209.

The foregoing steps S201 to S209 correspond to step S5 in FIG. 3. In the above-described manner, the phoneme duration initial value is obtained for all the phoneme strings in the expiratory paragraph subject to processing, and the process proceeds to step S211.

In step S211, the variable i is initialized to 1. In step S212, the phoneme duration di for the phoneme $\alpha i$ is determined so as to coincide with the speech production time T of the expiratory paragraph, based on the phoneme duration initial value for all the phonemes in the expiratory paragraph obtained in the previous process and the standard deviation of the phoneme $\alpha i$ in the category n (i.e., determined according to the equation (13a)). If the phoneme duration di obtained in step S212 is smaller than a threshold value $\theta\alpha i$ set for the phoneme $\alpha i$, the threshold value $\theta\alpha i$ is set to di (steps S213, S214, and equation (13b)).

The calculation of the phoneme duration di in steps S212 to S214 is performed for all the phoneme strings subject to processing. More specifically, the variable i is incremented in step S215, and steps S212 to S214 are repeated as long as the variable i is smaller than I in step S216.

The foregoing steps S211 to S216 correspond to step S6 in FIG. 3. In the above-described manner, the phoneme duration of all the phoneme strings for attaining the production time T is obtained with respect to the expiratory paragraph subject to processing.

Note that the construction of each of the above embodiments merely shows an embodiment of the present invention. Thus, various modifications are possible. An example of modifications includes the followings.

(1) In each of the above embodiments, the set of phonemes $\Omega$ si merely an example and thus a set of other elements may be used. Elements of a set of phonemes may be determined based on the type of language and phonemes. Also, the present invention is applicable to a language other than Japanese.

(2) In each of the above embodiments, the expiratory paragraph is an example of the phoneme duration setting section. Thus, a word, a morpheme, a clause, a sentence or the like may be set as a phoneme duration setting section. Note that if a sentence is set as the phoneme duration setting section, it is necessary to consider pause between phonemes.

(3) In each of the above embodiments, the phoneme duration of natural speech may be used as an initial value of the phoneme duration. Alternatively, a value determined by other phoneme duration control rules or a value estimated by Categorical Multiple Regression may be used.

(4) In the above second embodiment, the category corresponding to speech production speed, which is used to obtain an average value of the phoneme duration, is merely an example, and other categories may be used.

(5) In the above second embodiment, the factors for Categorical Multiple Regression and the categories are merely an example, and thus other factors and categories may be used.

(6) In each of the above embodiments, the coefficient $r_o$=3, which is multiplied to the standard deviation used for setting the phoneme duration initial value, is merely an example, thus another value may be set.

Further, the object of the present invention can also be achieved by providing a storage medium, storing software program codes instructing a computer to perform the above-described functions of the present embodiments, a computer system or an apparatus, reading the program codes (e.g., CPU or MPU) of the system or by providing such a storage medium to an apparatus for the storage medium, and then executing the program.

In this case, the program codes read from the storage medium realize the functions according to the above-described embodiments, and the storage medium storing the program codes constitutes the present invention.

A storage medium, such as a floppy disk, a hard disk, an optical disk, a magneto-optical disk, CD-ROM, CD-R, a magnetic tape, a non-volatile type memory card, and ROM can be used for providing the program codes.

Furthermore, the present invention includes a case where an OS (operating system) or the like working on the computer performs a part or the entire processes in accordance with the designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or the entire process in accordance with designations of the program codes and realizes functions of the above embodiments.

As has been set forth above, according to the present invention, a phoneme duration of a phoneme string can be set so as to achieve a specified speech production time. Thus, it is possible to realize natural phoneme duration regardless of the length of the speech production time.

As many apparently widely different embodiments of the present invention can be made without departing from the spirit and scope thereof, it is to be understood that the invention is not limited to the specific embodiments thereof except as defined in the claims.

What is claimed is:

1. A speech synthesizing apparatus for performing speech synthesis according to an inputted phoneme string, comprising:

storage means for storing statistical data, which comprises at least standard deviation data and multiple regression analysis data, related to a phoneme duration of each phoneme;

determining means for determining the speech production time for the inputted phoneme string;

first initial value obtaining means for obtaining an estimated duration with respect to each phoneme by a multiple regression analysis using the multiple regression anaylsis data stored in said storing means;

setting means for setting an initial phoneme duration for each phoneme constructing the phoneme string based on the estimated duration;

calculating means for calculating a phoneme production time for each phoneme by adding a value calculated based on the standard deviation data of the phoneme which is obtained from said storage and the initial phoneme duration set for the phoneme, wherein the individual phoneme production times are determined so as to add up to the speech production time determined by said determination means; and generating means for generating a speech waveform by connecting phonemes having the calculated phoneme production time.

2. The speech synthesizing apparatus according to claim 1, wherein said setting means sets the initial phoneme duration within a predetermined time range determined based on the statistical data stored in said storage means, with respect to each phoneme constructing the phoneme string.

3. The speech synthesizing apparatus according to claim 1, wherein the statistical data stored in said storage means includes an average value, a standard deviation, and a minimum value of the phoneme duration of each phoneme, and said setting means sets the initial duration to fall within a predetermined time range determined based on the average value, the standard deviation, and the minimum value of the phoneme duration, with respect to each phoneme.

4. The speech synthesizing apparatus according to claim 3, wherein said storage means stores a threshold value indicating the minimum phoneme production period of each phoneme, and wherein said apparatus further comprises means form replacing the phoneme production time calculated by said calculation means by the threshold value, for each phoneme, when the calculated phoneme production time is smaller than the threshold value.

5. The speech synthesizing apparatus according to claim 1, wherein said calculated means employs, as a coefficient, a value obtained by subtracting a total initial phoneme duration from the speech production time and dividing the subtracted value by a sum of squares of the standard deviation corresponding to each phoneme, and sets as the phoneme duration, a value obtained by adding a product of the coefficient and a square of the standard deviation of the phoneme the initial phoneme duration.

6. The speech synthesizing apparatus according to claim 1, wherein if the estimated duration falls within a predetermined time range, said first initial value setting means sets the estimated duration as the initial phoneme duration, while if the estimated duration exceeds the predetermined time range, said first initial value setting means sets the initial phoneme duration to fall within the predetermined time range.

7. The speech synthesizing apparatus according to claim 1, further comprising a second initial value obtaining means for obtaining an estimated duration based on an average time, obtained by dividing the speech production time by the number of phonemes constructing the phoneme string, to each phoneme, and wherein said setting means selectively utilizes said first initial value obtaining means or said second initial value obtaining means in accordance with the type of phoneme.

8. The speech synthesizing apparatus according to claim 1, wherein said storage means stores statistical data related to a phoneme duration of each phoneme for each category based on a speech production speed, and said calculating means determining a category production speed based on the speech production time and the phoneme string, and calculates the phoneme production time of each phoneme based on statistical data belonging to the determined category as well as the estimated duration.

9. The speech synthesizing apparatus according to claim 1, wherein said calculating means calculates a subtracted value obtained by subtracting a total initial phoneme duration from the speech production time, and calculating a phoneme production time for each phoneme by adding a value calculated based on the standard deviation data of the phoneme and the subtracted value.

10. A speech synthesizing method of performing speech synthesis according to an inputted phoneme string, comprising the steps of:

determining the speech production time of the inputted phoneme string in a predetermined section;

obtaining an estimated duration with respect to each phoneme by a multiple regression analysis using multiple regression anaylsis data stored in storing means;

setting an initial phoneme duration for each phoneme constructing the phoneme string based on the estimated duration;

calculating a phoneme production time for each phoneme by adding a value calculated based on a standard deviation data of the phoneme which is obtained from storage means for storing statistical data, which comprises at least standard deviation data and the multiple regression analysis data related to the phoneme duration of each phoneme and the initial phoneme duration set for the phoneme, wherein the individual phoneme production times are determined so as to add up to the speech production time determined by said determining step; and generating a speech waveform by connecting phonemes having the calculated phoneme production time.

11. The speech synthesizing method according to claim 10, wherein said setting step includes:

a setting step of setting the initial phoneme duration within a predetermined time range determined based on the statistical data stored in said storage unit, with respect to each phoneme constructing the phoneme string.

12. The speech synthesizing method according to claim 10, wherein the statistical data stored in said storage unit includes an average value, a standard deviation, and a minimum value of the phoneme duration of each phoneme, and said setting step sets the initial duration to fall within a predetermined time range determined based on the average value, the standard deviation, and the minimum value of the phoneme duration, with respect to each phoneme.

13. The speech synthesizing method according to claim 12, wherein the storage means stores a threshold value indicating the minimum phoneme production period of each phoneme, and wherein said method further comprises a step for replacing the phoneme production time calculated by said calculation step by the threshold value, for each phoneme, when the calculated phoneme production time is smaller than the threshold value.

14. The speech synthesizing method according to claim 10, wherein said calculating step employs, as a coefficient, a value obtained by subtracting a total initial phoneme duration from the speech production time and dividing the subtracted value by a sum squares of the standard deviation corresponding to each phoneme, and a value obtained by adding a product of the coefficient and a square of the standard deviation of the phoneme to the initial phoneme duration, is set as the phoneme duration.

15. The speech synthesizing method according to claim 10, wherein, if the estimated duration fall within a predetermined time range, said setting step sets the estimated duration as the initial phoneme duration, while if the estimated duration exceeds the predetermined time range, said setting step sets the initial phoneme duration to fall within the predetermined time range.

16. The speech synthesizing method according to claim 10, further comprising a second initial value obtaining step of obtaining an estimated duration based on an average time, obtained by dividing the speech production time by the number of phonemes constructing the phoneme string, to each phoneme, and wherein said setting step selectively utilizes the first initial value obtaining step or the second initial value obtaining step in accordance with the type of phoneme.

17. The speech synthesizing method according to claim 10, wherein said storage unit stores statistical data related to a phoneme duration of each phoneme for each category based on a speech production speed, and in said calculating step, a category of speech production speed is determined based on the speech production time and the phoneme string, and the phoneme production time of each phoneme is calculated based on statistical data belonging to the determined category as well as the estimated duration.

18. The speech synthesizing method according to claim 10, wherein the calculating step calculates a subtracted value by subtracting a total initial phoneme duration from the speech production time, and calculating a phoneme production time for each phoneme by adding a value calculated based on the standard deviation data of the phoneme and the subtracted value.

19. A storage medium storing a control program for instructing a computer to perform a speech synthesizing process for performing speech synthesis according to an inputted phoneme string, said control program comprising:

codes for instructing the computer to determine the speech production time for the inputted phoneme string;

codes for obtaining an estimated duration with respect to each phoneme by a multiple regression analysis using multiple regression analysis data stored in storing means;

codes for instructing the computer to set an initial phoneme duration for each phoneme constructing the phoneme string based on the estimated duration;

calculating the phoneme production time for each phoneme by adding a value calculated based on the standard deviation data of the phoneme which is obtained from the storage means for storing statistical data, which comprises at least standard deviation data and the multiple regression analysis data, related to the phoneme duration of each phoneme and the initial phoneme duration set for the phoneme, wherein the individual phoneme production times are determined so as to add up to the speech production time determined by said computer in response to the codes for instructing the computer to determine the speech production time for the inputted phoneme string; and codes for instructing the computer to generate a speech waveform by connecting phonemes having the calculated phoneme production time.

* * * * *

UNITED STATES PATENT AND TRADEMARK OFFICE

CERTIFICATE OF CORRECTION

PATENT NO. : 6,546,367 B2
DATED : April 8, 2003
INVENTOR(S) : Mitsuru Otsuka

It is certified that error appears in the above-identified patent and that said Letters Patent is hereby corrected as shown below:

Title page,
Item [54], Title, "ON VALUES" should read -- VALUES --.
Item [56], References Cited, OTHER PUBLICATIONS, insert
-- R.E. Donovan and P.C. Woodland, "Improvements in an HMM-Based Speech Synthesizer," Proc. 4th European Conference on Speech Communication and Technology, EUROSPEECH '95, September 1995. --.
Item [57], ABSTRACT,
Line 2, "a" (2nd occurrence) should read -- the --.
Line 13, "range, phoneme." should read -- range. --.

Column 1,
Line 4, "ON" should be deleted.
Lien 33, "control rule" should read -- control-rule --.
Line 37, "a" should be deleted.
Line 40, "of" (1st occurrence) should be deleted.
Line 46, "a" (2nd occurrence) should read -- the --.
Lines 59 and 60, "which" should read -- that --.

Column 2,
Line 1, "a" should read -- the --.
Line 3, "determining" should read -- determining the --, and "speech production" should read -- speech-production --.
Line 14, "programs" should read -- program --.
Line 66, "which" should read -- that --.

Column 3,
Line 6, "as" should read -- as a --; and "floppy" should read -- a floppy --.
Line 7, "CD-ROM" should read -- a CD-ROM --.
Line 10, "display" should read -- display operations --.
Line 14, "on" should read -- of --.
Line 53, "$di < \theta\mu i$" should read -- $di < \theta\alpha i$ --.

Column 5,
Line 20, "of" should read -- of the --.
Line 25, "then" should read -- and then --.
Lines 35 and 42, "a" should read -- the --.

Column 6,
Line 29, "maxi-" should read -- a maxi- --.

UNITED STATES PATENT AND TRADEMARK OFFICE

CERTIFICATE OF CORRECTION

PATENT NO. : 6,546,367 B2
DATED : April 8, 2003
INVENTOR(S) : Mitsuru Otsuka

It is certified that error appears in the above-identified patent and that said Letters Patent is hereby corrected as shown below:

Column 7,
Line 26, “which” should read -- that --.
Line 30, “satisfy” should read -- satisfy the --.

Column 8,
Line 4, “analysis,” should read -- analysis --.

Column 11,
Line 42, “unit 2.” should read -- unit 1. --.
Line 48, “speech” should read -- the speech --.
Line 50, “and” should read -- and the --.
Line 60, “to” should be deleted.
Line 63, “S7,” should read -- S7, a --.
Line 66, “pitch of voice” should read -- the pitch of the voice --.

Column 12,
Line 41, “E,” should read -- e, --.
Line 44, “to” should read -- to the --.

Column 13,
Line 40, “si” should read -- is --; and “example” should read -- example, --.
Line 50, “pause” should read -- a pause --.
Line 57, “speech” should read -- the speech --.
Line 67, “thus” should read -- and thus --.

Column 14,
Line 4, “apparatus,” should read -- apparatus --.
Line 32, “realize” should read -- realize a --.

UNITED STATES PATENT AND TRADEMARK OFFICE

CERTIFICATE OF CORRECTION

PATENT NO. : 6,546,367 B2
DATED : April 8, 2003
INVENTOR(S) : Mitsuru Otsuka

It is certified that error appears in the above-identified patent and that said Letters Patent is hereby corrected as shown below:

Column 15,
Line 20, “form” should read -- for --.
Line 32, “the” should read -- to the --.

Column 16,
Line 54, “sum” should read -- sum of --.

Signed and Sealed this

Twenty-seventh Day of January, 2004

JON W. DUDAS
*Acting Director of the United States Patent and Trademark Office*